US012478121B2

(12) United States Patent
Camp

(10) Patent No.: US 12,478,121 B2
(45) Date of Patent: Nov. 25, 2025

(54) SURGICAL GOWN

(71) Applicant: Bard Access Systems, Inc., Salt Lake City, UT (US)

(72) Inventor: Harper Camp, North Salt Lake, UT (US)

(73) Assignee: Bard Access Systems, Inc., Salt Lake City, UT (US)

( * ) Notice: Subject to any disclaimer, the term of this patent is extended or adjusted under 35 U.S.C. 154(b) by 62 days.

(21) Appl. No.: 17/686,286

(22) Filed: Mar. 3, 2022

(65) Prior Publication Data

US 2023/0276873 A1 Sep. 7, 2023

(51) Int. Cl.
*A41D 13/12* (2006.01)
*A41D 27/10* (2006.01)

(52) U.S. Cl.
CPC ..... *A41D 13/1209* (2013.01); *A41D 27/10* (2013.01); *A41D 2400/44* (2013.01); *A41D 2400/52* (2013.01)

(58) Field of Classification Search
CPC ..... A41D 13/1209; A41D 13/1227; A41D 19/0089; A41D 27/10; A61B 42/40
See application file for complete search history.

(56) References Cited

U.S. PATENT DOCUMENTS 1,183,792 A * 5/1916 Aron ..... A41D 27/10 2/270
2,226,066 A * 12/1940 Moe ..... A41D 27/10 2/270
4,756,027 A * 7/1988 Buenos ..... A41D 19/0041 2/206
5,784,720 A * 7/1998 Mellon ..... A41D 19/0041 2/60
5,815,837 A * 10/1998 Christman ..... A41D 19/0041 2/125
2008/0250539 A1* 10/2008 Cutlip ..... A41D 13/084 2/16
2017/0156425 A1* 6/2017 Jeong ..... A41D 27/02
2021/0068481 A1* 3/2021 Edwards ..... A41D 19/0006

FOREIGN PATENT DOCUMENTS

EP 0507607 A1 10/1992
EP 3852564 A1 7/2021
GB 2245148 A 1/1992
WO 2020057677 A1 3/2020

OTHER PUBLICATIONS

Dictionary definition of "proximal" (https://www.merriam-webster.com/dictionary/proximal) (Year: 2025).*
PCT/US2023/014375 filed Mar. 2, 2023 International Search Report and Written Opinion dated Jun. 7, 2023.

* cited by examiner

*Primary Examiner* — Sally Haden
(74) *Attorney, Agent, or Firm* — Rutan & Tucker LLP

(57) ABSTRACT

Disclosed herein is a disposable surgical gown. The disposable surgical gown includes a gown body having a pair of opposing sleeves, with each sleeve including a cuff at a distal end and two or more finger sleeves proximal the cuff at a first distance from the cuff. The two or more finger sleeves can extend from a lateral side of each sleeve.

10 Claims, 6 Drawing Sheets

FIG. 3C
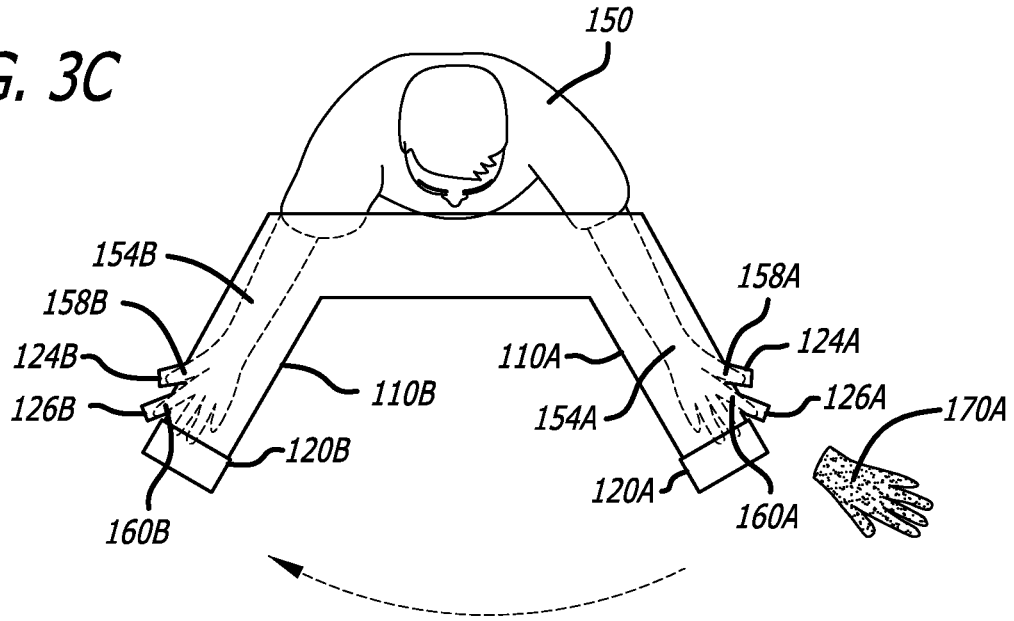
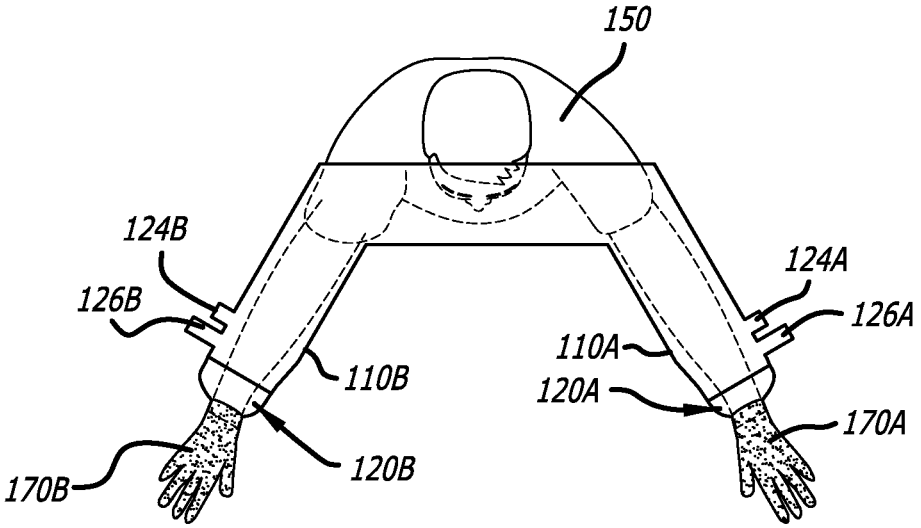
FIG. 3D

SURGICAL GOWN

BACKGROUND

It is important to maintain sterility when donning a surgical gown for a surgical procedure. Current methods utilize a cuff of the gown to manipulate packaging of gloves to maintain sterility while donning the gloves. Utilizing the cuff limits mobility and dexterity of the user while donning the gloves. It would be beneficial to the user to have a surgical gown that allowed the user to maintain sterility while increasing the mobility and the dexterity of the user while donning gloves. Disclosed herein is a surgical gown, method of donning the surgical gown, and method of manufacturing the surgical gown that address the foregoing.

SUMMARY

Disclosed herein is a disposable surgical gown. The disposable surgical gown includes a gown body having a pair of opposing sleeves, with each sleeve including a cuff at a distal end and two or more finger sleeves proximal the cuff at a first distance from the cuff. The two or more finger sleeves extend from a lateral side of each sleeve.

In some embodiments, the disposable surgical gown is symmetrical across a vertical axis.

In some embodiments, the two or more finger sleeves includes a first finger sleeve proximal a second finger sleeve. The first finger sleeve has a first finger sleeve length, the second finger sleeve has a second finger sleeve length greater than the first finger sleeve length, and in some embodiments, the second finger sleeve length is greater than the first finger sleeve length by a factor within the range of 1.1-2.5.

In some embodiments, each of the two or more finger sleeves includes a distal end having a gripping surface coupled to the finger sleeves, and in some embodiments, the gripping surface includes a textured rubber gripping surface.

In some embodiments, the first finger sleeve is angled at a first angle within the range of 90-145° in relation to the lateral side of each sleeve and the second finger sleeve is angled at a second angle within the range of 90-145° in relation to the lateral side of each sleeve with the second angle being greater than the first angle.

Also disclosed herein is a method of donning a disposable surgical gown. The method includes inserting a first arm having a first finger and a second finger into a first sleeve of a surgical gown, where the first arm is adjacent to two or more finger sleeves extending from a lateral side of the first sleeve and being a first distance from a cuff of the first sleeve. The method further includes inserting a second arm into a second sleeve of the surgical gown until the second arm is adjacent to two or more finger sleeves extending from a lateral side of the second sleeve, and inserting the first finger into the first finger sleeve and inserting the second finger into the second finger sleeve. The method further includes grasping a first surgical glove with the first finger and the second finger and sliding the first surgical glove over a cuff of the second sleeve, and sliding a second surgical glove over the cuff of the first sleeve.

In some embodiments, grasping the first surgical glove with the first finger and the second finger and sliding the first surgical glove over the cuff of the second sleeve includes sliding a second hand of the second arm into the first surgical glove.

In some embodiments, grasping the first surgical glove with the first finger and the second finger includes grasping the first surgical glove with a distal end of each of the first finger sleeve and the second finger sleeve, where the distal end of each of the first finger sleeve and the second finger sleeve includes a gripping surface.

In some embodiments, sliding the second surgical glove over the cuff of the first sleeve includes using the gloved second hand to slide the second surgical glove over the cuff of the first sleeve.

Also disclosed herein is a method of manufacturing a disposable surgical gown including generating two opposing sleeves, where each sleeve includes two or more finger sleeves extending from a lateral side of each sleeve, the two or more finger sleeves a first distance from a cuff of each sleeve, coupling the two opposing sleeves to a gown body, and packaging the disposable surgical gown.

In some embodiments, generating two opposing sleeves includes tracing a sleeve pattern outline on a first material and cutting or stamping the sleeve pattern outline from the first material.

In some embodiments, generating two opposing sleeves, where each sleeve includes two or more finger sleeves includes a first finger sleeve having a first finger sleeve length and a second finger sleeve having a second finger sleeve length greater than the first finger sleeve length, with the first finger sleeve proximal the second finger sleeve.

In some embodiments, generating two opposing sleeves, where each sleeve includes two or more finger sleeves includes the second finger sleeve length being greater than the first finger sleeve length by a factor within the range of 1.1-2.5.

In some embodiments, generating two opposing sleeves, where each sleeve includes two or more finger sleeves includes the first finger sleeve being angled at a first angle from the lateral side and the second finger sleeve being angled at a second angle from the lateral side, with the second angle being greater than the first angle, and in some embodiments, each of the first angle and the second angle are within the range of 90-145° in relation to the lateral side.

In some embodiments, generating two opposing sleeves includes coupling a gripping surface to a distal end of each of the two or more finger sleeves.

In some embodiments, coupling the gripping surface to the distal end of each of the two or more finger sleeves includes coupling the gripping surface including a textured rubber gripping surface to the distal end of each of the two or more finger sleeves.

In some embodiments, coupling the two opposing sleeves to the gown body includes adhering or sewing a proximal end of each of the opposing sleeves to a proximal end of the gown body.

In some embodiments, coupling the two opposing sleeves to the gown body includes coupling the two opposing sleeves to the gown body so that the disposable surgical gown is symmetrical over a vertical axis.

In some embodiments, packaging the disposable surgical gown includes folding the disposable surgical gown and placing the disposable surgical gown in single use packaging and sterilizing the disposable surgical gown in the single use packaging.

These and other features of the concepts provided herein will become more apparent to those of skill in the art in view of the accompanying drawings and following description, which describe particular embodiments of such concepts in greater detail.

DRAWINGS

A more particular description of the present disclosure will be rendered by reference to specific embodiments thereof that are illustrated in the appended drawings. It is appreciated that these drawings depict only typical embodiments of the invention and are therefore not to be considered limiting of its scope. Example embodiments of the invention will be described and explained with additional specificity and detail through the use of the accompanying drawings in which:

FIGS. 3A-3D illustrate a top cross sectional view of an exemplary method of donning a surgical gown, in accordance with some embodiments.

Figure 4:
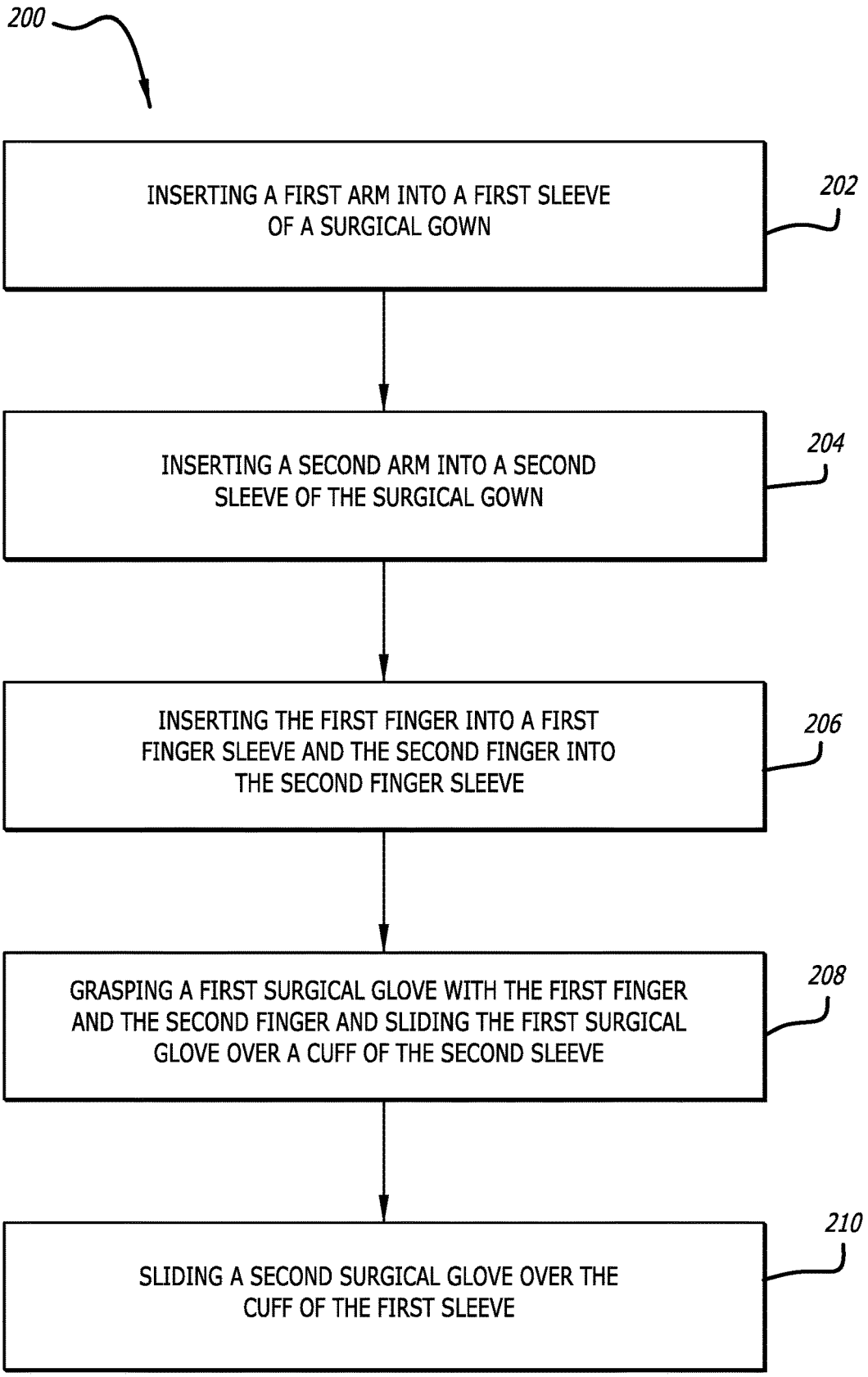

FIG. 4. illustrates a flow chart of the exemplary method of donning the surgical gown, in accordance with some embodiments.

Figure 5:
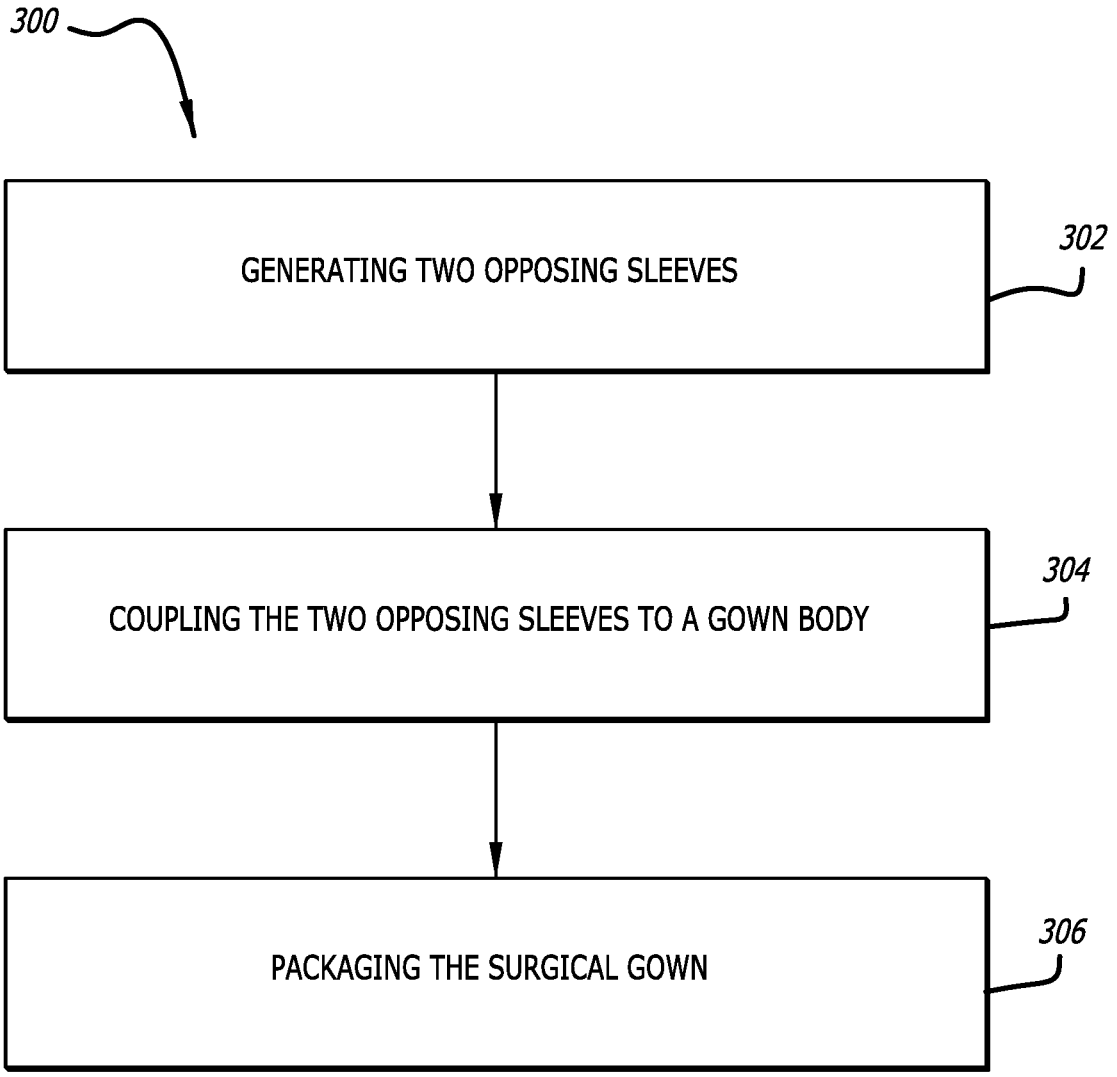

FIG. 5 illustrates a flow chart of an exemplary method of manufacturing a surgical gown, in accordance with some embodiments.

DESCRIPTION

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "top," "bottom," "front," "back," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

Unless defined otherwise, all technical and scientific terms used herein have the same meaning as commonly understood by those of ordinary skill in the art.

Figure 1:
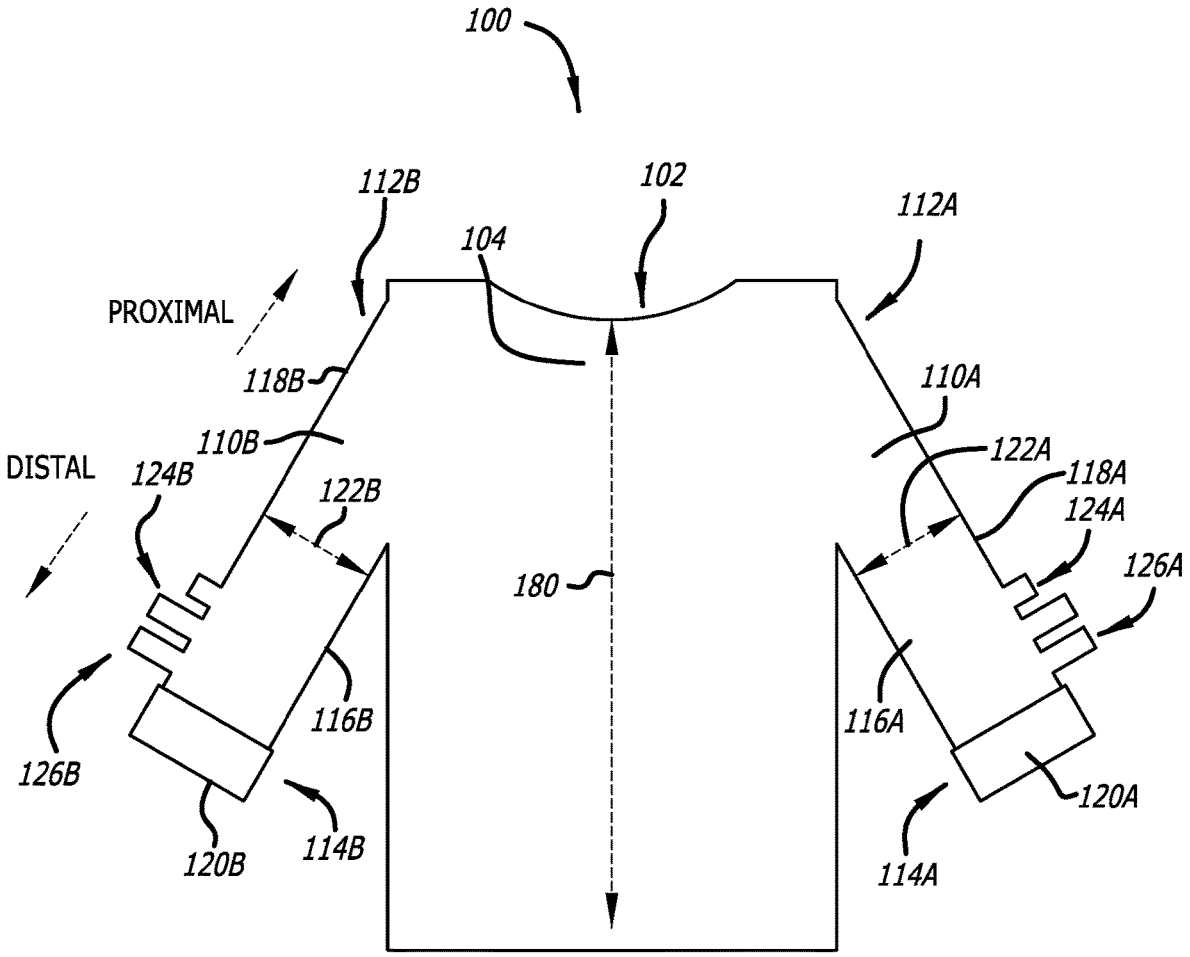
FIG. 1 illustrates a plan view of a surgical gown, in accordance with some embodiments.

FIG. 1 illustrates a plan view of a surgical gown 100, in accordance with some embodiments. In some embodiments, the surgical gown 100 includes a gown body 104 having a pair of opposing sleeves 110A/110B. In some embodiments, the surgical gown 100 may be symmetrical across a vertical axis 180. In some embodiments, a proximal end 112A/112B of each sleeve 110A/110B may be coupled to a proximal end 102 of the gown body 104. In some embodiments, each sleeve 110A/110B may have a medial side 116A/116B and a lateral side 118A/118B, wherein the medial side 116A/116B is adjacent to the gown body 104. In some embodiments, each sleeve 110A/110B may include a cuff 120A/120B located at a distal end 114A/114B of the sleeve 110A/110B. In some embodiments, the cuff 120A/120B may include elastic material therein configured to cinch the cuff 120A/120B around an appendage threaded therethrough. In some embodiments, the surgical gown 100 may be disposable.

In some embodiments, each sleeve 110A/110B may include a sleeve diameter 122A/112B. In some embodiments, the sleeve diameter 122A/122B may be consistent from the proximal end 112A/112B of the sleeve 110A/110B to the distal end 114A/114B of the sleeve 110A/110B. In some embodiments, the sleeve diameter 122A/112B may be tapered from the proximal end 112A/112B of the sleeve 110A/110B to the distal end 114A/114B of the sleeve 110A/110B with a larger sleeve diameter 122A/112B at the proximal end 112A/112B and a smaller sleeve diameter 122A/122B at the distal end 114A/114B.

In some embodiments, each sleeve 110A/110B may include two or more finger sleeves 124A/124B and 126A/126B extending therefrom. In some embodiments, the two or more finger sleeves 124A/124B and 126A/126B may extend from the lateral side 118A/118B. In some embodiments, each of the two or more finger sleeves 124A/124B and 1261/126B may extend from each sleeve 110A/110B proximal the cuff 120A/120B. During deployment of the surgical gown 100, as a user slidably inserts their arms into the pair of sleeves 110A/110B, the user may slide fingers into the two or more finger sleeves 124A/126A or 124B/126B to manipulate packaging materials of gloves, other medical apparel, or medical devices while maintaining sterility, as will be described in more detail herein. Advantageously, the two or more finger sleeves 124A/124B and 126A/126B may be used to allow the user to maintain dexterity and sterility while efficiently donning surgical gloves.

Figure 2A:
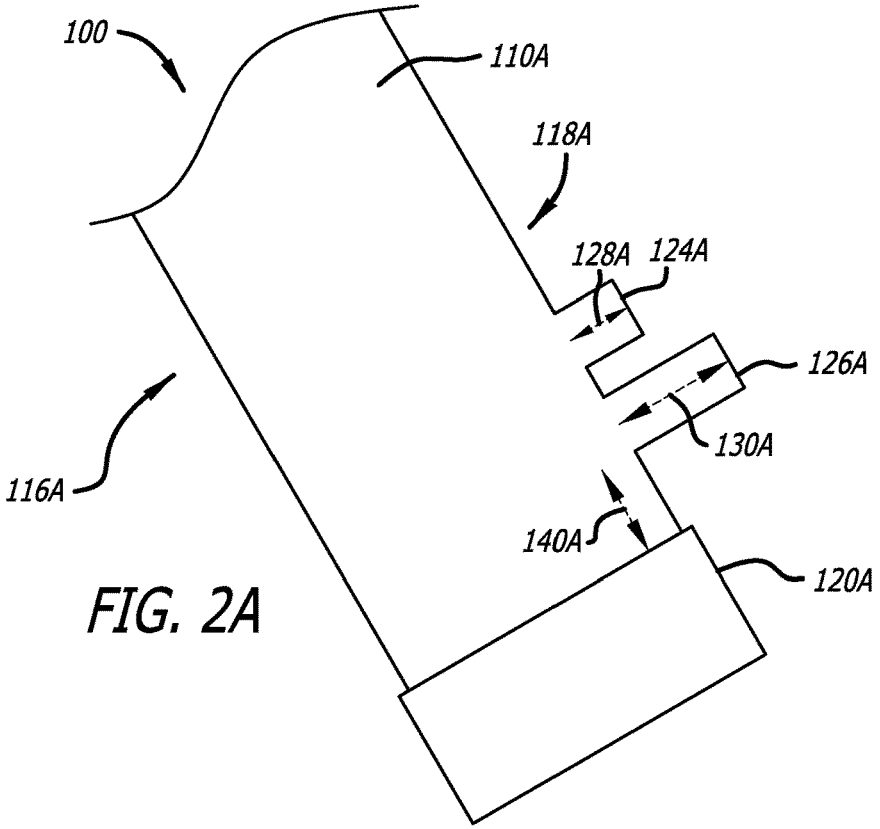
FIGS. 2A-2B illustrates a plan view of a first sleeve of the surgical gown, in accordance with some embodiments.

FIG. 2A illustrates a plan view of the sleeve 110A of the surgical gown 100, in accordance with some embodiments. In some embodiments, the two or more finger sleeves 124/126 include a first finger sleeve 124A proximal a second finger sleeve 126A. In some embodiments, the finger sleeves 124A/124B may extend from the lateral side 118 of the sleeve 110A a first distance 140A from the cuff 120. In some embodiments, the first finger sleeve 124A may have a first finger sleeve length 128A and the second finger sleeve 126A may have a second finger sleeve length 130A. In some embodiments, the second finger sleeve length 130A may be greater than the first finger sleeve length 128A. In some embodiments, the second finger sleeve length 130A may be greater than the first finger sleeve length 128A by a factor within the range of 1.1-2.5. Advantageously, the first finger sleeve length 128A being shorter than the second finger sleeve length 130A may orient the user to the correct orientation of the surgical gown 100.

Figure 2B:
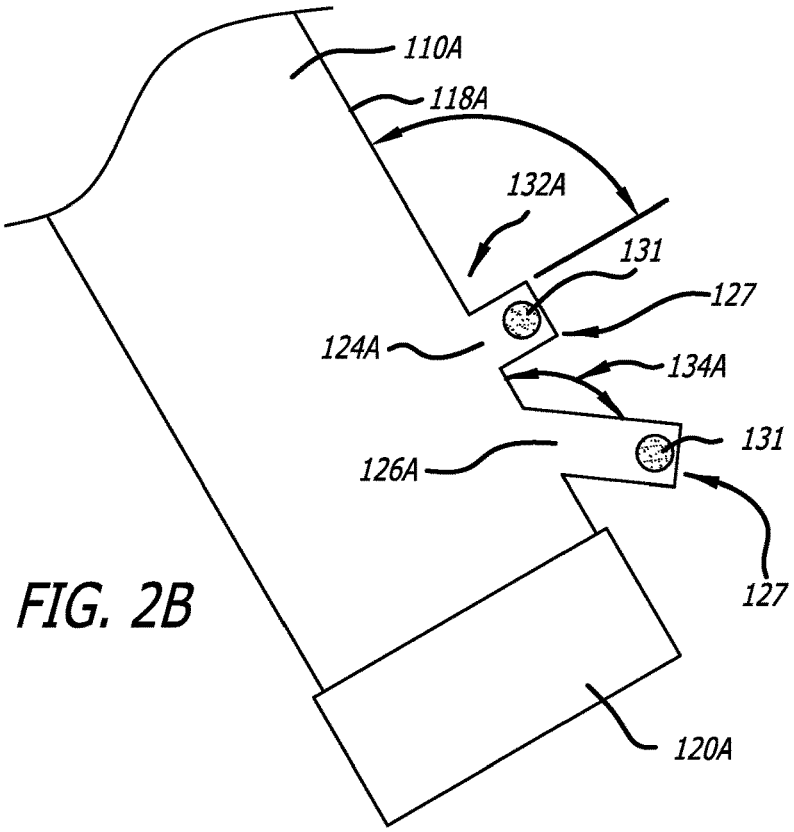

FIG. 2B illustrates a plan view of the first sleeve 110A of the surgical gown 100, in accordance with some embodiments. In some embodiments, the first finger sleeve 124A and the second finger sleeve 126A may extend from the lateral side 118A of the first sleeve 110A at any angle within the range of 90-145° in relation to the lateral side 118A. In some embodiments, each of the first finger sleeve 124A and the second finger sleeve 126A may be independently angled or may be concurrently angled. For example, the first finger sleeve 124A may be angled at a first angle 132A of 90° in relation to the lateral side 118 and the second finger sleeve 126A may be angled at a second angle 134A of 120° in relation to the lateral side 118. In some embodiments, the first finger sleeve 124A having the first angle 132A and the second finger sleeve 126A having the second angle 134A greater than the first angle 132A may be configured to allow the user to easily slidably insert a finger into the finger sleeves 124A/126A and maintain dexterity while wearing the surgical gown 100.

In some embodiments, each finger sleeve 124A/126A may include a distal end 127 having a gripping surface 131 thereon. In some embodiments, the gripping surface 131 may include textured rubber, textured polymers, or the like. In some embodiments, the gripping surface 131 may be scored to increase friction between the gripping surface 131 and an object in contact with the gripping surface 131 (e.g., surgical gloves, portions of the surgical gown 100, or the like). In some embodiments, the gripping surface 131 may be coupled to the distal end 127 or may be integrated into the distal end 127 of each finger sleeve 124/126.

FIGS. 3A-3D illustrate a top cross sectional view of an exemplary method of donning the surgical gown 100, in accordance with some embodiments. In some embodiments, the surgical gown 100 may be removed from packaging within a sterile field. In some embodiments, the surgical gown 100 may be unfolded after being removed from the packaging within a sterile field. In some embodiments, the surgical gown 100 may be placed on a flat surface (e.g., gowning station, table, or the like) within the sterile field. In some embodiments, a user 150 may orient the surgical gown 100 within the sterile field to most easily be accessed and put on. The user 150 may extend a first arm 152A having a first hand 154A and a second arm 152B having a second hand 154B outwards from the user 150 and may rotate each of the first hand 154A and the second hand 154B axially, until a first palm 156A of the first hand 154A and a second palm 156B of a second hand 154B is facing upward.

Figure 3A:
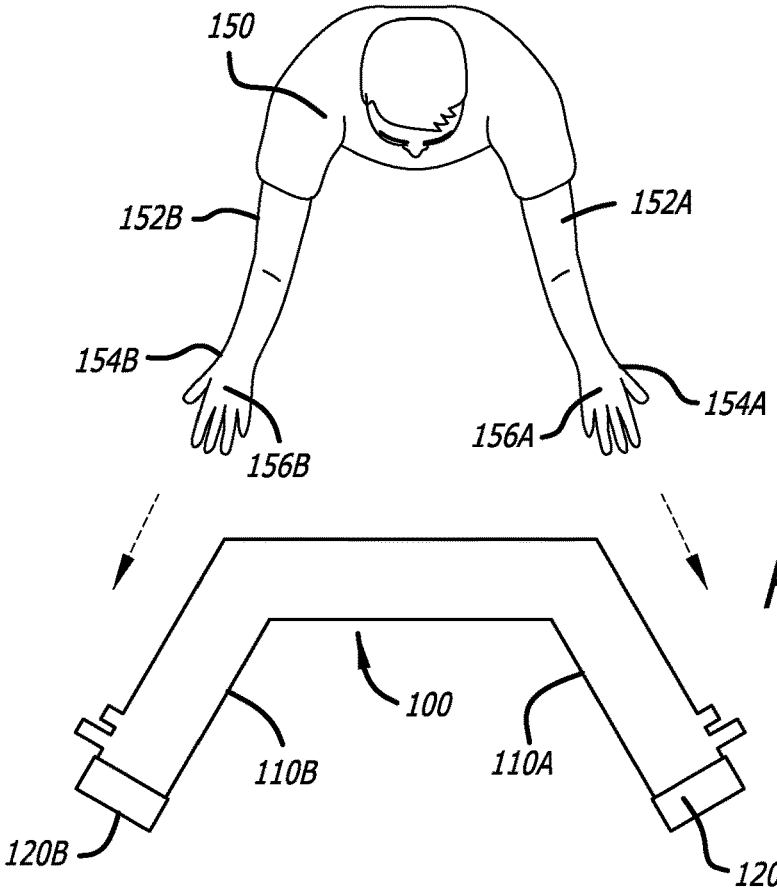
Figure 3B:
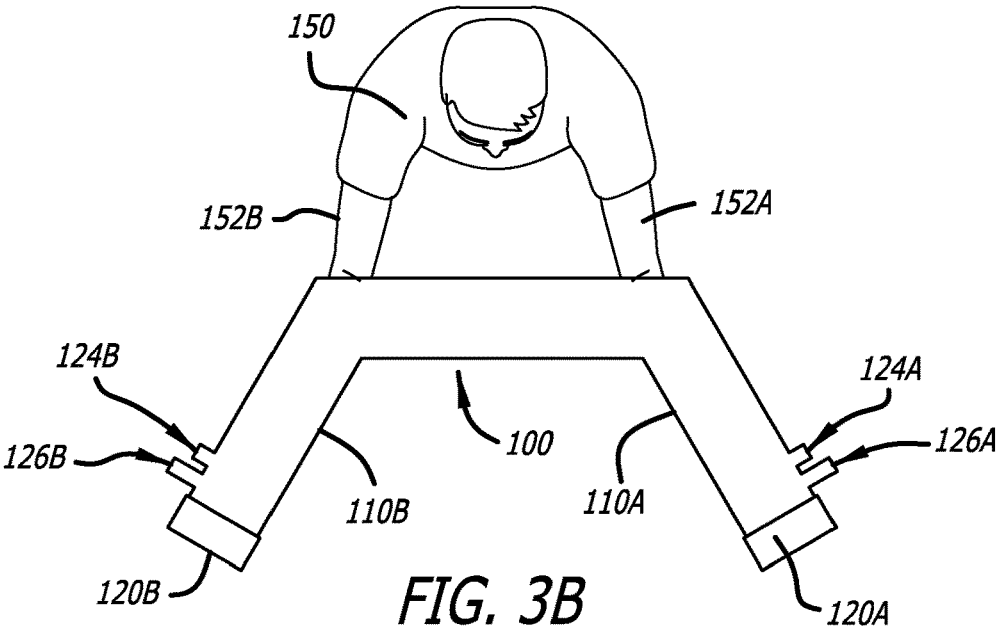

As illustrates in FIG. 3B, the user 150 may don the surgical gown 100 while placing the first arm 152A including the first hand 154A into the first sleeve 110A and placing the second arm 152B including the second hand 154B into the second sleeve 110B. The user may slide the first arm 152A through the first sleeve 110A until the first hand 154A is adjacent to the finger sleeves 124A/126A extending from the first sleeve 110A, the finger sleeves 124A/126A being proximal the cuff 120A of the first sleeve 110A. The user may slide the second arm 152B through the second sleeve 110B until the second hand 154B is adjacent to the finger sleeves 124B/126B extending from the second sleeve 110B, the finger sleeves 124B/126B being proximal the cuff 120B of the second sleeve 110B As illustrated in FIG. 3C, with the first hand 154A adjacent to the finger sleeves 124A/126A and the second hand 154B adjacent to the finger sleeves 124B/126B, as illustrated in FIG. 3C, the user 150 may slide a first finger 158A from the first hand 154A into the first finger sleeve 124A and a second finger 160A from the first hand 154A into the second finger sleeve 126A. In some embodiments, the first finger 158A may be a thumb and the second finger 160A may be an index finger. In some embodiments, with the first finger 158A in the first finger sleeve 124A and the second finger 160A in the second finger sleeve 126A, the user 150 may grasp a first surgical glove 170A and slide the first surgical glove 170A over the cuff 120B of the second sleeve 110B. It can also be appreciated that the user 150 may prefer to glove the first hand 154A first and may first slide a first finger 158B from the second hand 154B into the first finger sleeve 124B and a second finger 160B from the second hand 154B into the second finger sleeve 126B and using the first finger 158A and the second finger 160A may grasp the first surgical glove 170A and slide the surgical glove 170A over the cuff 120A of the first sleeve 110A.

As illustrated in FIG. 3D, once the user 150 has the first surgical glove 170A pulled over the cuff 120B, the user 150 may use the gloved hand 154B to place a second surgical glove 170B over the cuff 120A of the first sleeve 110A so that both the first hand 154A and the second hand 154B are properly gloved and the user 150 is properly gowned, all while maintaining sterility.

FIG. 4 illustrates a flow chart of an exemplary method 200 of donning the disposable surgical gown 100, in accordance with some embodiments. In some embodiments, the method 200 including inserting the first arm 152A having at least a first finger 158A and a second finger 160A into a first sleeve 110A of the disposable surgical gown 100, wherein the first arm 152A is adjacent to two or more finger sleeves 124/126 extending from the lateral side 118A of the first sleeve 110A, the two or more finger sleeves 124/126 being a first distance 140A from a cuff 120A (block 202). In some embodiments, inserting the first arm 152A includes inserting the first arm 152A wherein the first arm 152A includes a left arm or a right arm. In some embodiments, inserting the first arm 152A wherein the first arm 152A is adjacent to the two or more finger sleeves 124A/126A extending from the first sleeve 110A includes the two or more finger sleeves 124A/126A including the first finger sleeve 124A having a first finger sleeve length 128A less than a second finger sleeve length 130A of the second finger sleeve 126A.

The method 200 includes inserting the second arm 152B into a second sleeve 110B of the surgical gown 100, wherein the second arm 152B is adjacent to two or more finger sleeves 124B/126B extending from the second sleeve 110B (block 204). In some embodiments, inserting the second arm 152B into the second sleeve 110B includes the second sleeve 110B opposed to the first sleeve 110A. In some embodiments, inserting the second arm 152B into the second sleeve 110B of the surgical gown 100 includes the disposable surgical gown 100 being symmetrical over a vertical axis 180.

The method 200 includes inserting the first finger 158A of the first arm 152A into the first finger sleeve 124A and the second finger 160A of the first arm 152A into the second finger sleeve 126A, the first finger sleeve 124A proximal the second finger sleeve 126A (block 206). In some embodiments, inserting the first finger 158A into the first finger sleeve 124A and the second finger 160A into the second finger sleeve 126A includes inserting the first finger 158A into the first finger sleeve 124A having a first angle 132A in relation to the lateral side 118A of the first sleeve 110A. In some embodiments, inserting the second finger 160A into the second finger sleeve 126A includes inserting the second finger 160A into the second finger sleeve 126A having a second angle 134A in relation to the lateral side 118A. In some embodiments, the second angle 134A may be greater than the first angle 132A with each of the first angle 132A and the second angle 134A within the range of 90-145° in relation to the lateral side 118A.

The method 200 includes grasping a first surgical glove 170A with the first finger 158A and the second finger 160A of the first arm 152A and sliding the first surgical glove 170A over a cuff 120B of the second sleeve 110B (block 208). In some embodiments, grasping the first surgical glove 170A with the first finger 158A and the second finger 160A includes the grasping the first surgical glove 170A with the first finger 152A within the first finger sleeve 124A and the second finger 160A within the second finger sleeve 126A. In some embodiments, grasping the first surgical glove 170A with the first finger 152A and the second finger 160A includes grasping the first surgical glove 170A with a distal end 127 of each the first finger sleeve 124A and the second finger sleeve 126A having a gripping surface 131 thereon. In some embodiments, the gripping surface 131 may include a textured rubber surface. In some embodiments, sliding the first surgical glove 170A over the cuff 120B of the second sleeve 110B includes sliding the second hand 154B into the first surgical glove 170B.

The method 200 includes sliding a second surgical glove 170B over the cuff 120A of the first sleeve 110A (block 210). In some embodiments, sliding the second surgical glove 170B over the cuff 120A includes using the gloved second hand 154B to slide the second surgical glove 170B over the cuff 120A of the first sleeve 110A onto the first hand 154A.

FIG. 5 illustrates a flow chart of an exemplary method 300 of manufacturing the disposable surgical gown 100, in accordance with some embodiments. In some embodiments, the method 300 includes generating two opposing sleeves 110A/110B wherein each sleeve 110A/110B includes two or more finger sleeves 124A/126B and 124B/126B extending from a lateral side 118A/118B of each sleeve 110A/110B, the two or more finger sleeves 124A/126A and 124B/126B a first distance 140 from a cuff 120A/120B of each sleeve 110A/110B (block 302). In some embodiments, generating two opposing sleeves 110A/110B includes coupling the cuff 120A/120B to the distal end 114A/114B of each of the first sleeve 110A and the second sleeve 110B.

In some embodiments, generating two opposing sleeves 110A/110B wherein each sleeve 110A/110B includes two or more finger sleeves 124A/126B and 124B/126B extending from a lateral side 118A/118B of each sleeve 110A/110B includes tracing a sleeve pattern outline onto a first material and cutting or stamping the sleeve pattern outline from the first material. In some embodiments, generating the two opposing sleeves 110A/110B includes generating the two opposing sleeves 110A/110B without the two or more finger sleeves 124A/126A and 124B/126B and coupling the two or more finger sleeves 124A/126A and 124B/126B to the lateral side 118A/118B of each of the two opposing sleeves 110A/110B. In some embodiments, coupling the two or more finger sleeves 124A/126A and 124B/126B to the lateral side 118A/118B of each of the two opposing sleeves 110A/110B includes sewing, gluing, stitching, adhering the two or more finger sleeves 124A/126A and 124B/126B to the lateral side 118A/118B of each of the two opposing sleeves 110A/110B.

In some embodiments, generating two opposing sleeves 110A/110B wherein each sleeve 110A/110B includes two or more finger sleeves 124A/126A and 124B/126B includes generating two opposing sleeves 110A/110B wherein the first finger sleeve 124A is angled at a first angle 132A and the second finger sleeve 126A is angled at a second angle 134A greater than the first angle 132A with each angle within the range of 90-145° in relation to the lateral side 118A. It can also be appreciated that the first finger sleeve 124B of the sleeve 110B is angled at a first angle 132B and the second finger sleeve 126B is angled at a second angle 134B greater than the first angle 132B with each angle within the range of 90-145° in relation to the lateral side 118B. It can also be appreciated that the first angle 132A may be equal to the first angle 132B and the second angle 134A may be equal to the second angle 134B. In some embodiments, generating two opposing sleeves 110A/110B wherein each sleeve 110A/110B includes two or more finger sleeves 124A/126A and 124B/126B includes generating two opposing sleeves 110A/110B wherein the first finger sleeve 124A is proximal the second finger sleeve 126A.

In some embodiments, generating two opposing sleeves 110A/110B wherein each sleeve 110A/110B includes two or more finger sleeves 124A/126A and 124B/126B includes the first finger sleeve 124A/124B having a first finger sleeve length 128A/128B shorter than a second finger sleeve length 130A/120B of the second finger sleeve 126A/126B. In some embodiments, the second finger sleeve length 130A/130B may be greater than the first finger sleeve length 128A/128B by a factor within the range of 1.1-2.5.

In some embodiments, generating two opposing sleeves 110A/110B includes the two or more finger sleeves 124A/126A and 124B/126B extending from the lateral side 118A/118B of each sleeve 110A/110B the first distance 140A/140B from the cuff 120A/120B at a distal end 114A/114B of each sleeve 110A/110B. In some embodiments, generating two opposing sleeves 110A/110B wherein each sleeve 110A/110B includes the two or more finger sleeves 124A/126A and 124B/126B extending from the lateral side 118A/118B of each sleeve 110A/110B includes coupling a gripping surface 131 to a distal end 127 of each finger sleeve 124A/124B and 126A/126B. In some embodiments, coupling the gripping surface 131 to the distal end 127 of each finger sleeve 124A/124B and 126A/126B includes the gripping surface 131 being a textured rubber gripping surface.

The method 300 includes coupling the two opposing sleeves 110A/110B to a gown body 104 (block 304). In some embodiments, coupling the two opposing sleeves 110A/110B to the gown body 104 includes adhering, sewing, binding, knitting the two opposing sleeves 110A/110B to the gown body 104. In some embodiments, coupling the two opposing sleeves 110A/110B to the gown body 104 includes coupling the two opposing sleeves 110A/110B to the gown body 104 so that the surgical gown 100 is symmetrical over a vertical axis 180. In some embodiments, coupling the two opposing sleeves 110A/110B to the gown body 104 includes coupling the proximal end 112A/112B of each sleeve 110A/110B to the proximal end 102 of the gown body 104.

The method 300 includes packaging the disposable surgical gown 100 (block 306). In some embodiments, packaging the disposable surgical gown 100 includes folding the disposable surgical gown 100 and placing the disposable surgical gown 100 in single use packaging. In some embodiments, packaging the disposable surgical gown 100 includes sterilizing the disposable surgical gown 100 in the single use packaging.

While some particular embodiments have been disclosed herein, and while the particular embodiments have been disclosed in some detail, it is not the intention for the particular embodiments to limit the scope of the concepts provided herein. Additional adaptations and/or modifications can appear to those of ordinary skill in the art, and, in broader aspects, these adaptations and/or modifications are encompassed as well. Accordingly, departures may be made from the particular embodiments disclosed herein without departing from the scope of the concepts provided herein.

What is claimed is:

1. A disposable surgical gown, comprising:

a gown body having:

a body portion; and pair of opposing sleeves extending away from the body portion, wherein:

each sleeve of the pair of opposing sleeves includes:

a cuff at a distal end of each sleeve, the cuff defining a proximal end of the cuff;

two finger sleeves positioned proximal the cuff such that the two finger sleeves are positioned a first distance proximally away from the proximal end of the cuff; and a medial side facing inward toward the body portion and a lateral side opposite the medial side, the lateral side facing away from the body portion when the disposable surgical gown is not donned by a user and when each sleeve is extended away from the body portion in an unfolded state, the two finger sleeves are disposed on the lateral side, and the two finger sleeves extend externally outward away from the lateral side of each sleeve of the opposing sleeves.

2. The disposable surgical gown according to claim 1, wherein the disposable surgical gown is symmetrical across a vertical axis.

3. The disposable surgical gown according to claim 2, wherein the two finger sleeves includes a first finger sleeve proximal a second finger sleeve, the first finger sleeve having a first finger sleeve length and the second finger sleeve having a second finger sleeve length greater than the first finger sleeve length.

4. The disposable surgical gown according to claim 3, wherein the second finger sleeve length is greater than the first finger sleeve length by a factor within a range of 1.1-2.5.

5. The disposable surgical gown according to claim 3, wherein each of the two finger sleeves includes a distal end having a gripping surface coupled thereto.

6. The disposable surgical gown according to claim 5, wherein the gripping surface includes a textured rubber gripping surface.

7. The disposable surgical gown according to claim 3, wherein the first finger sleeve is angled at a first angle within a range of 90-145° in relation to the lateral side of each sleeve and the second finger sleeve is angled at a second angle within a range of 90-145° in relation to the lateral side of each sleeve with the second angle being greater than the first angle.

8. The disposable surgical gown according to claim 1, wherein the two finger sleeves are attached to each sleeve at a location proximal the proximal end of the cuff.

9. The disposable surgical gown according to claim 1, wherein the two finger sleeves extend outward away from the lateral side at an angle between 90 and 145 degrees.

10. The disposable surgical gown according to claim 1, wherein each sleeve is configured to enable insertion of a wearer's arm through each sleeve such that a wearer's hand extends distally beyond the two finger sleeves and distally away from a distal end of each sleeve.

* * * * *